US006217739B1

(12) United States Patent
Ray et al.

(10) Patent No.: US 6,217,739 B1
(45) Date of Patent: Apr. 17, 2001

(54) ELECTROLYTIC PRODUCTION OF HIGH PURITY ALUMINUM USING INERT ANODES

(75) Inventors: Siba P. Ray, Murrysville; Xinghua Liu, Monroeville; Douglas A. Weirauch, Jr., Murrysville, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/431,756

(22) Filed: Nov. 1, 1999

Related U.S. Application Data

(63) Continuation-in-part of application No. 09/241,518, filed on Feb. 1, 1999, now Pat. No. 6,126,799, which is a continuation-in-part of application No. 08/883,061, filed on Jun. 26, 1997, now Pat. No. 5,865,980.

(51) Int. Cl.[7] ..... C25C 3/08

(52) U.S. Cl. ..... 205/385; 205/386; 205/387; 205/372; 205/380

(58) Field of Search ..... 205/372, 380, 205/385, 386, 387

(56) References Cited

U.S. PATENT DOCUMENTS

| | | | |
|---|---|---|---|
| 3,996,117 | 12/1976 | Graham et al. | 204/67 |
| 4,288,302 | 9/1981 | De Nora et al. | 204/105 |
| 4,302,321 | 11/1981 | DeNora et al. | 204/291 |
| 4,374,050 | 2/1983 | Ray | 252/519 |
| 4,374,761 | 2/1983 | Ray | 252/519 |
| 4,397,729 | 8/1983 | Duruz et al. | 204/243 |
| 4,399,008 | 8/1983 | Ray | 204/67 |
| 4,455,211 | 6/1984 | Ray | 204/293 |
| 4,472,258 | 9/1984 | Secrist et al. | 204/292 |
| 4,478,693 * | 10/1984 | Ray | 204/291 |
| 4,552,630 | 11/1985 | Wheeler et al. | 204/67 |
| 4,582,585 | 4/1986 | Ray | 204/243 |
| 4,584,172 | 4/1986 | Ray et al. | 419/34 |
| 4,620,905 | 11/1986 | Tarcy et al. | 204/64 |
| 4,871,437 | 10/1989 | Marschman et al. | 204/291 |
| 4,871,438 | 10/1989 | Marschman et al. | 204/291 |
| 4,960,494 | 10/1990 | Nguyen et al. | 204/67 |
| 5,019,225 | 5/1991 | Darracq et al. | 204/67 |
| 5,254,232 | 10/1993 | Sadoway | 204/243 |
| 5,279,715 | 1/1994 | LaCamera | 204/64 |
| 5,284,562 | 2/1994 | Beck et al. | 204/243 |
| 5,378,325 | 1/1995 | Dastolfo, Jr. et al. | 204/66 |
| 5,794,112 | 8/1998 | Ray et al. | 419/21 |
| 5,865,980 | 2/1999 | Ray et al. | 205/367 |
| 5,938,914 | 8/1999 | Dawless et al. | 205/391 |
| 6,030,518 * | 2/2000 | Dawless et al. | 205/387 |

* cited by examiner

*Primary Examiner*—Bruce F. Bell
(74) *Attorney, Agent, or Firm*—Alan G. Towner; Edward L. Levine; Glenn E. Klepac

(57) ABSTRACT

A method of producing commercial purity aluminum in an electrolytic reduction cell comprising inert anodes is disclosed. The method produces aluminum having acceptable levels of Fe, Cu and Ni impurities. The inert anodes used in the process preferably comprise a cermet material comprising ceramic oxide phase portions and metal phase portions.

31 Claims, 3 Drawing Sheets

ELECTROLYTIC PRODUCTION OF HIGH PURITY ALUMINUM USING INERT ANODES

CROSS REFERENCE TO RELATED APPLICATIONS

This application is a continuation-in-part of U.S. Ser. No. 09/241,518 filed Feb. 1, 1999, now U.S. Pat. No. 6,126,799, which is a continuation-in-part of U.S. Ser. No. 08/883,061 filed Jun. 26, 1997, now U.S. Pat. No. 5,865,980 issued Feb. 2, 1999, each of which is incorporated herein by reference.

GOVERNMENT CONTRACT

The United States Government has certain rights in this invention pursuant to Contract No. DE-FC07-98ID13666 awarded by the United States Department of Energy.

FIELD OF THE INVENTION

The present invention relates to the electrolytic production of aluminum. More particularly, the invention relates to the production of commercial purity aluminum with an electrolytic reduction cell including inert anodes.

BACKGROUND OF THE INVENTION

The energy and cost efficiency of aluminum smelting can be significantly reduced with the use of inert, nonconsumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,794,112 and 5,865,980, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, e.g., about 900–1,000° C., so that the voltage drop at the anode is low.

In addition to the above-noted criteria, aluminum produced with the inert anodes should not be contaminated with constituents of the anode material to any appreciable extent. Although the use of inert anodes in aluminum electrolytic reduction cells has been proposed in the past, the use of such inert anodes has not been put into commercial practice. One reason for this lack of implementation has been the long-standing inability to produce aluminum of commercial grade purity with inert anodes. For example, impurity levels of Fe, Cu and/or Ni have been found to be unacceptably high in aluminum produced with known inert anode materials.

The present invention has been developed in view of the foregoing, and to address other deficiencies of the prior art.

SUMMARY OF THE INVENTION

An aspect of the present invention is to provide a process for producing high purity aluminum using inert anodes. The method includes the steps of passing current between an inert anode and a cathode through a bath comprising an electrolyte and aluminum oxide, and recovering aluminum comprising a maximum of 0.15 weight percent Fe, 0.1 weight percent Cu, and 0.03 weight percent Ni.

Additional aspects and advantages of the invention will occur to persons skilled in the art from the following detailed description thereof

DETAILED DESCRIPTION

Figure 1:
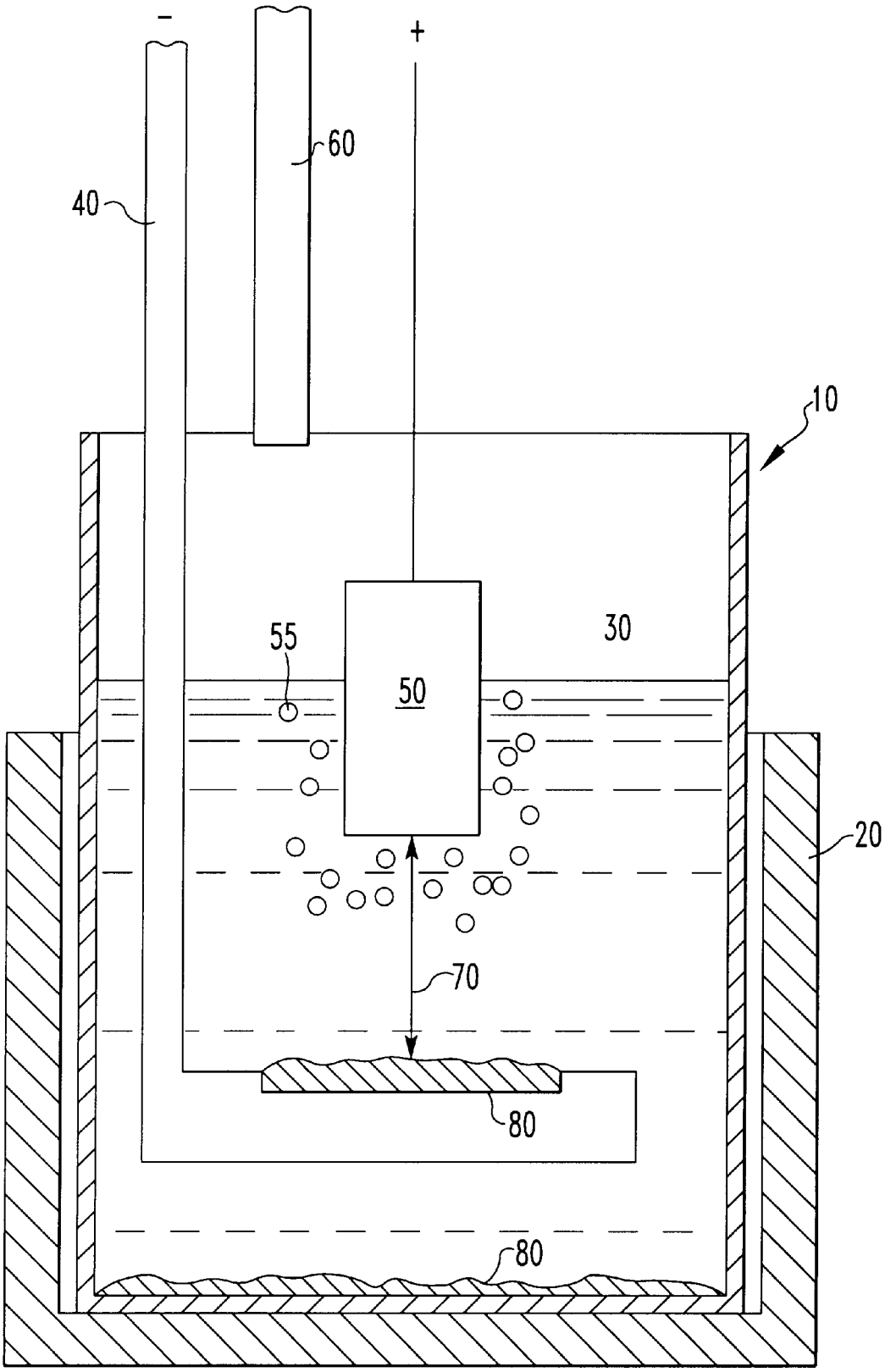
FIG. 1 is a partially schematic sectional view of an electrolytic cell with an inert anode that is used to produce commercial purity aluminum in accordance with the present invention.

FIG. 1 schematically illustrates an electrolytic cell for the production of commercial purity aluminum which includes an inert anode in accordance with an embodiment of the present invention. The cell includes an inner crucible 10 inside a protection crucible 20. A cryolite bath 30 is contained in the inner crucible 10, and a cathode 40 is provided in the bath 30. An inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Commerical purity aluminum 80 produced during a run is deposited on the cathode 40 and on the bottom of the crucible 10.

As used herein, the term "inert anode" means a substantially nonconsumable anode which possesses satisfactory corrosion resistance and stability during the aluminum production process. In a preferred embodiment, the inert anode comprises a cermet material.

As used herein, the term "commercial purity aluminum" means aluminum which meets commercial purity standards upon production by an electrolytic reduction process. The commercial purity aluminum comprises a maximum of 0.2 weight percent Fe, 0.1 weight percent Cu, and 0.034 weight percent Ni. In a preferred embodiment, the commercial purity aluminum comprises a maximum of 0.15 weight percent Fe, 0.034 weight percent Cu, and 0.03 weight percent Ni. More preferably, the commercial purity aluminum comprises a maximum of 0.13 weight percent Fe, 0.03 weight percent Cu, and 0.03 weight percent Ni. Preferably, the commercial purity aluminum also meets the following weight percentage standards for other types of impurities: 0.2 maximum Si, 0.03 Zn. and 0.03 Co. The Si impurity level is more preferably kept below 0.15 or 0.10 weight percent.

Inert anodes of the present invention preferably have ceramic phase portions and metal phase portions. The ceramic phase typically comprises at least 50 weight percent of the anode, preferably from about 70 to about 90 weight percent. It is noted that for every numerical range or limit set forth herein, all numbers with the range or limit including every fraction or decimal between its stated minimum and maximum, are considered to be designated and disclosed by this description.

The ceramic phase portions preferably comprise iron and nickel oxides, and at least one additional oxide such as zinc oxide and/or cobalt oxide. For example, the ceramic phase may be of the formula; $Ni_{1-x-y}$ $Fe_{2-x}$ $M_y$ O; where M is perferably Zn and/or Co; x is from 0 to 0.5; and y is from 0 to 0.6. More preferably X is from 0.05 to 0.2, and y is from 0.01 to 0.5. Table 1 lists some ternary Fe—Ni—Zn—O materials that may be suitable for use as the ceramic phase of a cermet inert anode.

TABLE 1

| Sample I.D. | Nominal Composition | Elemental Weight Percent Fe, Ni, Zn | Structural Types |
|---|---|---|---|
| 5412 | $NiFe_2O_4$ | 48, 23.0, 0.15 | $NiFe_2O_4$ |
| 5324 | $NiFe_2O4$ + NiO | 34, 36, 0.06 | $NiFe_2O_4$, NiO |
| E4 | $Zn_{0.05}Ni_{0.95}Fe_2O_4$ | 43, 22, 1.4 | $NiFe_2O_4$, TU* |
| E3 | $Zn_{0.1}Ni_{0.9}Fe_2O_4$ | 43, 20, 2.7 | $NiFe_2O_4$, TU* |
| E2 | $Zn_{0.25}Ni_{0.75}Fe_2O_4$ | 40, 15, 5.9 | $NiFe_2O_4$, TU* |
| E1 | $Zn_{0.25}Ni_{0.75}Fe_{1.90}O_4$ | 45, 18, 7.8 | $NiFe_2O_4$, TU* |
| E | $Zn_{0.5}Ni_{0.5}Fe_2O_4$ | 45, 12, 13 | $(ZnNi)Fe_2O_4$, $TP^+ZnO^s$ |
| F | $ZnFe_2O_4$ | 43, 0.03, 24 | $ZnFe_2O_4$, $TP^+ZnO$ |
| H | $Zn_{0.5}NiFe_{1.5}O_4$ | 33, 23, 13 | $(ZnNi)Fe_2O_4$, $NiO^s$ |
| J | $Zn_{0.5}Ni_{1.5}FeO_4$ | 26, 39, 10 | $NiFe_2O_4$, $MP^+NiO$ |
| L | $ZnNiFeO_4$ | 22, 23, 27 | $(ZnNi)Fe_2O_4$, $NiO^s$, ZnO |
| ZD6 | $Zn_{0.05}Ni_{1.05}Fe_{1.9}O_4$ | 40, 24, 1.3 | $NiFe_2O_4$, TU* |
| ZD5 | $Zn_{0.1}Ni_{1.1}Fe_{1.8}O_4$ | 29, 18, 2.3 | $NiFe_2O_4$, TU* |
| ZD3 | $Zn_{0.12}Ni_{0.94}Fe_{1.88}O_4$ | 43, 23, 3.2 | $NiFe_2O_4$, TU* |
| ZD1 | $Zn_{0.12}Ni_{0.94}Fe_{1.88}O_4$ | 40, 20, 11 | $(ZnNi)Fe_2O_4$, TU* |
| DH | $Zn_{0.18}Ni_{0.96}Fe_{1.8}O_4$ | 42, 23, 4.9 | $NiFe_2O_4$, $TP^+NiO$ |
| DI | $Zn_{0.08}Ni_{1.17}Fe_{1.5}O_4$ | 38, 30, 2.4 | $NiFe_2O_4$, $MP^+NiO$, TU* |
| DJ | $Zn_{0.17}Ni_{1.1}Fe_{1.5}O_4$ | 36, 29, 4.8 | $NiFe_2O_4$, $MP^+NiO$ |
| BC2 | $Zn_{0.33}Ni_{0.67}O$ | 0.11, 52, 25 | $NiO^s$, TU* |

Figure 2:
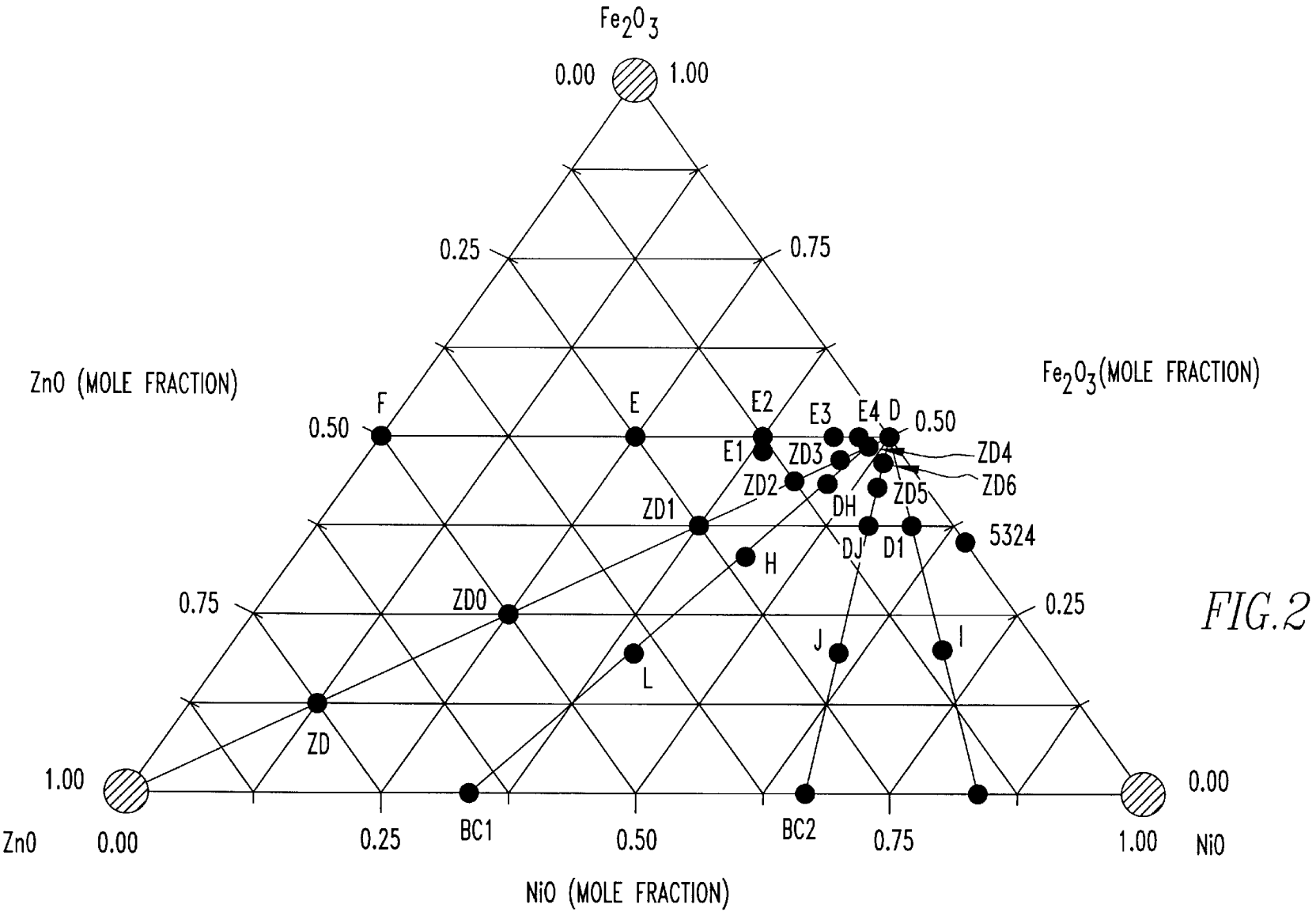
FIG. 2 is a ternary phase diagram illustrating amounts of iron, nickel and zinc oxides present in an inert anode that may be used to make commercial purity aluminum in accordance with an embodiment of the present invention.

*TU means trace unidentified; +TP means trace possible; +MP means minor possible; S means shifted peak FIG. 2 is a ternary phase diagram illustrating the amounts of $Fe_2O_3$, NiO and ZnO starting materials used to make the compositions listed in Table 1, which may be used as the ceramic phase(s) of cermet inert anodes. Such inert anodes may in turn be used to produce commercial purity aluminum in accordance with the present invention.

In one embodiement, when $Fe_2O_3$, NiO and ZnO are used as starting materials for making an inert anode, they are typically mixed together in ratios of 20 to 99.09 mole percent NiO, 0.01 to 51 mole percent $Fe_2O_3$, and zero to 30 mole percent ZnO. Perferably, such starting materials are mixed together in ratios of 45 to 65 mole percent NiO, 20 to 45 mole percent $Fe_2O_3$, and 0.01 to 22 mole percent ZnO.

Table 2 lists some ternary $Fe_2O_3$/NiO/CoO materials that may be suitable as the ceramic phase.

TABLE 2

| Sample I.D. | Nominal Composition | Analyzed Elemental Wgt. % Fe, Ni, Co | Structural Types |
|---|---|---|---|
| CF | $CoFe_2O_4$ | 44, 0.17, 24 | $CoFe_2O_4$ |
| NCF1 | $Ni_{0.5}Co_{05}Fe_2O_4$ | 44, 12, 11 | $NiFe_2O_4$ |
| NCF2 | $Ni_{0.7}Co_{03}Fe_2O_4$ | 45, 16, 7.6 | $NiFe_2O_4$ |
| NCF3 | $Ni_{0.7}Co_{0.3}Fe_{1.95}O_4$ | 42, 18, 6.9 | $NiFe_2O_4$, TU* |
| NCF4 | $Ni_{0.85}Co_{0.15}Fe_{1.95}O_4$ | 44, 20, 3.4 | $NiFe_2O_4$ |
| NCF5 | $Ni_{0.85}Co_{0.5}Fe_{1.9}O_4$ | 45, 20, 7.0 | $NiFe_2O_4$, NiO, TU* |
| NF | $NiFe_2O_4$ | 48, 23, 0 | N/A |

*TU means trace unidentified

Figure 3:
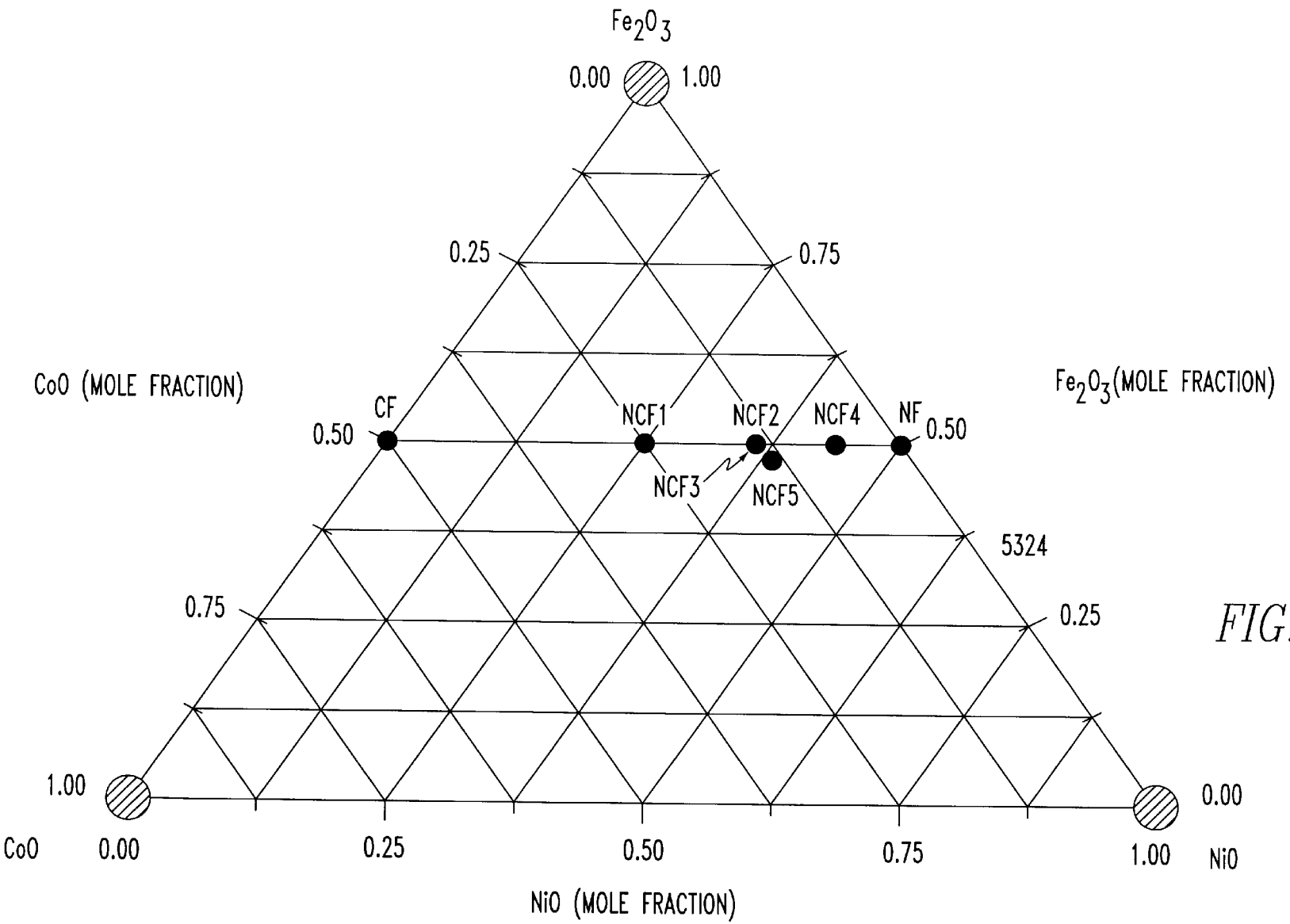
FIG. 3 is a ternary phase diagram illustrating amounts of iron, nickel and cobalt oxides present in an inert anode that may be used to make commercial purity aluminum in accordance with another embodiment of the present invention.

FIG. 3 is a ternary phase diagram illustrating the amounts of $Fe_2O_3$, NiO and CoO starting materials used to make the compositions listed in Table 2, which may be used as the ceramic phase(s) of cermet inert anodes. Such inert anodes may in turn be used to produce commercial purity aluminum in accordance with the present invention The cermet inert anodes used in accordance with a preferred aluminum production method of the present invention include at least one metal phase, for example, a base metal and at least one noble metal. Copper and silver are preferred base metals. However, other electrically conductive metals may optionally be used to replace all or part of the copper or silver. Furthermore, additional metals such as Co, Ni, Fe, Al, Sn, Nb, Ta, Cr, Mo, W and the like may be alloyed with the base metal. Such base metals may be provided from individual or alloyed powders of the metals, or as oxides of such metals.

The noble metal preferably comprises at least one metal selected from Ag, Pd, Pt, Au, Rh, Ru, Ir and Os. More preferably, the noble metal comprises Ag, Pd, Pt, Au and/or Rh. Most preferably, the noble metal comprises Ag, Pd or a combination thereof. The noble metal may be provided from individual or alloyed powders of the metals, or as oxides of such metals, e.g., silver oxide, palladium oxide, etc.

Preferably, metal phase(s) of the inert electrode comprises at least about 60 weight percent of the combined base metal and noble metal, more preferably at least about 80 weight percent. The presence of base metal/noble metal provides high levels of electrical conductivity through the inert electrodes. The base metal/noble metal phase may form either a continuous phase(s) within the inert electrode or a discontinuous phase(s) separated by the oxide phase(s).

The metal phase of the inert electrode typically comprises from about 50 to about 99.99 weight percent of the base metal, and from about 0.01 to about 50 weight percent of the noble metal(s). Preferably, the metal phase comprises from about 70 to about 99.95 weight percent of the base metal, and from about 0.05 to about 30 weight percent of the noble metal(s). More preferably, the metal phrase comprises from about 90 to about 99.9 weight percent of the base metal, and from about 0.1 to about 10 weight percent of the noble metal(s).

The types and amounts of base and noble metals contained in the metal phase of the inert anode are selected in order to substantially prevent unwanted corrosion, dissolution or reaction of the inert electrodes, and to withstand the high temperatures which the inert electrodes are subjected to during the electrolytic metal reduction process. For example, in the electrolytic production of aluminum, the production cell typically operates at sustained smelting temperatures above 800° C., usually at temperatures of 900–980° C. Accordingly, inert anodes used in such cells should preferably have melting points above 800° C., more preferably above 900° C., and optimally above about 1,000° C.

In one embodiment of the invention, the metal phase comprises copper as the base metal and a relatively small amount of silver as the noble metal. In this embodiment, the silver content is preferably less than about 10 weight percent, more preferably from about 0.2 to about 9 weight percent, and optimally from about 0.5 to about 8 weight percent, remainder copper. By combining such relatively small amounts of Ag with such relatively large amounts of Cu, the melting point of the Cu—Ag alloy phase is significantly increased. For example, an alloy comprising 95 weight percent Cu and 5 weight percent Ag has a melting point of approximately 1,000° C., while an alloy comprising 90 weight percent Cu and 10 weight percent Ag forms a eutectic having a melting point of approximately 780° C. This difference in melting points is particularly significant where the alloys are to be used as part of inert anodes in electrolytic aluminum reduction cells, which typically operate at smelting temperatures of greater than 800° C.

In another embodiment of the invention, the metal phase comprises copper as the base metal and a relatively small amount of palladium as the noble metal. In this embodiment, the Pd content is preferably less than about 20 weight percent, more preferably from about 0.1 to about 10 weight percent.

In a further embodiment of the invention, the metal phase comprises silver as the base metal and a relatively small amount of palladium as the noble metal. In this embodiment, the Pd content is preferably less than about 50 weight percent, more preferably from about 0.05 to about 30 weight percent, and optimally from about 0.1 to about 20 weight percent. Alternatively, silver may be used alone as the metal phase of the anode.

In another embodiment of the invention, the metal phase comprises Cu, Ag and Pd. In this embodiment, the amounts of Cu, Ag and Pd are preferably selected in order to provide an alloy having a melting point above 800° C., more preferably above 900° C., and optimally above about 1,000° C. The silver content is preferably from about 0.5 to about 30 weight percent of the metal phase, while the Pd content is preferably from about 0.01 to about 10 weight percent. More preferably, the Ag content is from about 1 to about 20 weight percent of the metal phase, and the Pd content is from about 0.1 to about 10 weight percent. The weight ratio of Ag to Pd is preferably from about 2:1 to about 100:1, more preferably from about 5:1 to about 20:1.

In accordance with a preferred embodiment of the present invention, the types and amounts of base and noble metals contained in the metal phase are selected such that the resultant material forms at least one alloy phase having an increased melting point above the eutectic melting point of the particular alloy system. For example, as discussed above in connection with the binary Cu—Ag alloy system, the amount of the Ag addition may be controlled in order to substantially increase the melting point above the eutectic melting point of the Cu—Ag alloy. Other noble metals, such as Pd and the like, may be added to the binary Cu—Ag alloy system in controlled amounts in order to produce alloys having melting points above the eutectic melting points of the alloy systems. Thus, binary, ternary, quaternary, etc. alloys may be produced in accordance with the present invention having sufficiently high melting points for use as part of inert electrodes in electrolytic metal production cells.

The inert anodes may be formed by techniques such as powder sintering, sol-gel processes, slip casting and spray forming. Preferably, the inert electrodes are formed by powder techniques in which powders comprising the oxides and metals are pressed and sintered. The inert anode may comprise a monolithic component of such materials, or may comprise a substrate having at least one coating or layer of such material.

Prior to combining the ceramic and metal powders, the ceramic powders, such as NiO, $Fe_2O_3$ and ZnO or CoO, may be blended in a mixer. Optionally, the blended ceramic powders may be ground to a smaller size before being transferred to a furnace where they are calcined, e.g., for 12 hours at 1,250° C. The calcination produces a mixture made from oxide phases, for example, as illustrated in FIGS. 2 and 3. If desired, the mixture may include other oxide powders such as $Cr_2O_3$.

The oxide mixture may be sent to a ball mill where it is ground to an average particle size of approximately 10 microns. The fine oxide particles are blended with a polymeric binder and water to make a slurry in a spray dryer. The slurry contains, e.g., about 60 wt. % solids and about 40 wt. % water. Spray drying the slurry produces dry agglomerates of the oxides that may be transferred to a V-blender and mixed with metal powders. The metal powders may comprise substantially pure metals and alloys thereof, or may comprise oxides of the base metal and/or noble metal.

In a preferred embodiment, about 1–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof Preferably, about 3–6 parts by weight of the binder are added to 100 parts by weight of the metal oxides, copper and silver.

The V-blended mixture of oxide and metal powders may be sent to a press where it is isostatically pressed, for example at 10,000 to 40,000 psi, into anode shapes. A pressure of about 20,000 psi is particularly suitable for many applications. The pressed shapes may be sintered in a controlled atmosphere furnace supplied with an argon-oxygen gas mixture. Sintering temperatures of 1,000–1,400° C. may be suitable. The furnace is typically operated at 1,350–1,385° C. for 2–4 hours. The sintering process burns out any polymeric binder from the anode shapes.

The sintered anode may be connected to a suitable electrically conductive support member within an electrolytic metal production cell by means such as welding, brazing, mechanically fastening, cementing and the like.

The gas supplied during sintering preferably contains about 5–3,000 ppm oxygen, more preferably about 5–700 ppm and most preferably about 10–350 ppm. Lesser concentrations of oxygen result in a product having a larger metal phase than desired, and excessive oxygen results in a product having too much of the phase containing metal oxides (ceramic phase). The remainder of the gaseous atmosphere preferably comprises a gas such as argon that is inert to the metal at the reaction temperature.

Sintering anode compositions in an atmosphere of controlled oxygen content typically lowers the porosity to acceptable levels and avoids bleed out of the metal phase. The atmosphere may be predominantly argon, with controlled oxygen contents in the range of 17 to 350 ppm. The anodes may be sintered in a tube furnace at 1,350° C. for 2 hours. Anode compositions sintered under these conditions typically have less than 0.5% porosity when the compositions are sintered in argon containing 70–150 ppm oxygen. In contrast, when the same anode compositions are sintered for the same time and at the same temperature in an argon atmosphere, porosities are substantially higher and the anodes may show various amounts of bleed out of the metal phase.

The inert anode may include a cermet as described above successively connected in series to a transition region and a nickel end. A nickel or nickel-chromium alloy rod may be welded to the nickel end. The transition region, for example, may include four layers of graded composition, ranging from 25 wt. % Ni adjacent the cermet end and then 50, 75 and 100 wt. % Ni, balance the mixture of oxide and metal powders described above.

We prepared several inert anode compositions in accordance with the procedures described above having diameters of about ⅝ inch and length of about 5 inches. These compositions were evaluated in a Hall-Heroult test cell similar to that schematically illustrated in FIG. 1. The cell was operated for 100 hours at 960° C., with an aluminum fluoride to sodium fluoride bath ratio of 1.1 and alumina concentration maintained at about 7–7.5 wt. %. The anode compositions and impurity concentrations in aluminum produced by the cell are shown in Table 3. The impurity values shown in Table 3 represent the average of four test samples of the produced metal taken at four different locations after the 100 hour test period. Interim samples of the produced aluminum were consistently below the final impurity levels listed.

TABLE 3

| Sample No. | Composition | Porosity | Fe | Cu | Ni |
|---|---|---|---|---|---|
| 1 | 3Ag—14Cu—42.9Ni)—40.1$Fe_2O_3$ | | 0.191 | 0.024 | 0.044 |
| 2 | 3Ag—14Cu—42.9Ni)—40.1$Fe_2O_3$ | | 0.26 | 0.012 | 0.022 |
| 3 | 3Ag—14Cu—26.45Ni)—56.55$Fe_2O_3$ | | 0.375 | 0.13 | 0.1 |
| 4 | 3Ag—14Cu—42.9Ni)—40.1$Fe_2O_3$ | | 0.49 | 0.05 | 0.085 |
| 5 | 3Ag—14Cu—42.9Ni)—40.1$Fe_2O_3$ | | 0.36 | 0.034 | 0.027 |
| 6 | 5Ag—10Cu—43.95Ni)—41.05$Fe_2O_3$ | | 0.4 | 0.06 | 0.19 |
| 7 | 3Ag—14Cu—42.9Ni)—40.1$Fe_2O_3$ | | 0.38 | 0.095 | 0.12 |
| 8 | 2Ag—15Cu—42.9Ni)—40.1$Fe_2O_3$ | | 0.5 | 0.13 | 0.33 |
| 9 | 2Ag—15Cu—42.9Ni)—40.1$Fe_2O_3$ | | 0.1 | 0.16 | 0.26 |
| 10 | 3Ag—11Cu—44.46Ni)—41.54$Fe_2O_3$ | | 0.14 | 0.017 | 0.13 |
| 11 | 1Ag—14Cu—27.75Ni)—57.25$Fe_2O_3$ | | 0.24 | 0.1 | 0.143 |
| 12 | 1Ag—14Cu—27.96Ni)—57.04$Fe_2O_3$ | 0.127 | 0.07 | 0.011 | 0.0212 |
| 13 | 1Ag—14Cu—27.96Ni)—57.04$Fe_2O_3$ | 0.168 | 0.22 | 0.04 | 0.09 |
| 14 | 1Ag—14Cu—27.96Ni)—57.04$Fe_2O_3$ | 0.180 | 0.1 | 0.03 | 0.05 |
| 15 | 1Ag—14Cu—27.96Ni)—57.04$Fe_2O_3$ | 0.175 | 0.12 | 0.04 | 0.06 |
| 16 | 1Ag—14Cu—27.96Ni)—57.04$Fe_2O_3$ | 0.203 | 0.08 | 0.02 | 0.1 |
| 17 | 1Ag—14Cu—27.96Ni)—57.04$Fe_2O_3$ | 0.230 | 0.12 | 0.01 | 0.04 |
| 18 | 1Ag—14Cu—27.96Ni)—57.04$Fe_2O_3$ | 0.184 | 0.17 | 0.18 | 0.47 |
| 19 | 1Ag—14Cu—27.96Ni)—57.04$Fe_2O_3$ | 0.193 | 0.29 | 0.044 | 0.44 |
| 20 | 1Ag—14Cu—5ZnO—28.08Ni)—56.92$Fe_2O_3$ | 0.201 | 0.16 | 0.02 | 0.02 |
| 21 | 1Ag—14Cu—27.96Ni)—57.04$Fe_2O_3$ | 0.144 | 0.44 | 0.092 | 0.15 |
| 22 | 1Ag—14Cu—5ZnO—28.08Ni)—56.92$Fe_2O_3$ | 0.191 | 0.48 | 0.046 | 0.17 |
| 23 | 1Ag—14Cu—5ZnO—28.08Ni)—56.92$Fe_2O_3$ | 0.214 | 0.185 | 0.04 | 0.047 |
| 24 | 1Ag—14Cu—27.96Ni)—57.04$Fe_2O_3$ | 0.201 | 0.15 | 0.06 | 0.123 |
| 25 | 1Ag—14Cu—5ZnO—28.08Ni)—56.92$Fe_2O_3$ | 0.208 | 0.22 | 0.05 | 0.08 |
| 26 | 1Ag—14Cu—27.96Ni)—57.04$Fe_2O_3$ | 0.201 | 0.18 | 0.03 | 0.08 |
| 27 | 1Ag—14Cu—5ZnO—28.08Ni)—56.92$Fe_2O_3$ | 0.252 | 0.21 | 0.05 | 0.08 |
| 28 | 1Ag—14Cu—27.96Ni)—57.04$Fe_2O_3$ | 0.203 | 0.21 | 0.057 | 0.123 |
| 29 | 1Ag—14Cu—27.35Ni)—55.95$Fe_2O_3$—1.7ZnO | 0.251 | 0.12 | 0.03 | 0.043 |
| 30 | 1Ag—14Cu—27.96Ni)—57.04$Fe_2O_3$ | 0.238 | 0.12 | 0.05 | 0.184 |
| 31 | 1Ag—14Cu—27.96Ni)—57.04$Fe_2O_3$ | 0.221 | 0.185 | 0.048 | 0.157 |
| 32 | 1Ag—14Cu—27.35Ni)—55.95$Fe_2O_3$—1.7ZnO | 0.256 | 0.16 | 0.019 | 0.028 |
| 33 | 1Pd—15Cu—40.48$Fe_2O_3$—43.32Ni)—0.2ZnO | 0.149 | 0.11 | 0.01 | 0.024 |
| 34 | 1Ag—14Cu—27.96Ni)—57.04$Fe_2O_3$ | 0.241 | 0.186 | 0.05 | 0.22 |
| 35 | 3Pd—14Cu—42.91Ni)—40.09$Fe_2O_3$ | 0.107 | 0.2 | 0.02 | 0.11 |
| 36 | 1Pt—15Cu—57.12$Fe_2O_3$—26.88NiO | 0.105 | 0.14 | 0.024 | 0.041 |
| 37 | 1Pd—15Cu—57$Fe_2O_3$—27.8Ni)—0.2ZnO | 0.279 | 0.115 | 0.014 | 0.023 |
| 38 | 1Pd—15Cu—40.48$Fe_2O_3$—43.32Ni)—0.2ZnO | 0.191 | 0.116 | 0.031 | 0.038 |
| 39 | 1Pd—15Cu—40.48$Fe_2O_3$—43.32Ni)—0.2ZnO | 0.253 | 0.115 | 0.07 | 0.085 |
| 40 | 0.5Pd—16Cu—43.27Ni)—40.43$Fe_2O_3$—0.2ZnO | 0.129 | 0.096 | 0.042 | 0.06 |
| 41 | 0.5Pd—16Cu—43.27Ni)—40.43$Fe_2O_3$—0.2ZnO | 0.137 | 0.113 | 0.033 | 0.084 |
| 42 | 0.1Pd—0.9Ag—15Cu—43.32Ni)—40.48$Fe_2O_3$—0.2ZnO | | 0.18 | 0.04 | 0.066 |
| 43 | 0.05Pd—0.95Ag—14Cu—27.9Ni)—56.9$Fe_2O_3$—0.2ZnO | 0.184 | 0.038 | 0.013 | 0.025 |
| 44 | 0.1Pd—0.9Ag—14Cu—27.9Ni)—56.9$Fe_2O_3$—0.2ZnO | 0.148 | 0.18 | 0.025 | 0.05 |
| 45 | 0.1Pd—0.9Ag—14Cu—27.35Ni)—55.95$Fe_2O_3$—1.7ZnO | 0.142 | 0.09 | 0.02 | 0.03 |
| 46 | 0.05Pd—0.95Ag—14Cu—27.35Ni)—55.95$Fe_2O_3$—1.7ZnO | 0.160 | 0.35 | 0.052 | 0.084 |
| 47 | 1Ru—14Cu—27.35Ni)—55.95$Fe_2O_3$—1.7ZnO | 0.215 | 0.27 | 0.047 | 0.081 |
| 48 | 0.1Pd—0.9Ag—14Cu—55.81$Fe_2O_3$—27.49Ni)—1.7ZnO | 0.222 | 0.31 | 0.096 | 0.18 |
| 49 | 1.86Ag(as $Ag_2O$)—14.02Cu—27.21Ni)—55.23$Fe_2O_3$—1.68ZnO | 0.147 | 0.15 | 0.008 | 0.027 |
| 50 | 0.1Pd—2.7Ag(as $Ag_2O$)—14.02Cu—26.9Ni)—54.6$Fe_2O_3$—1.66ZnO | 0.180 | 0.17 | 0.03 | 0.049 |
| 51 | 0.1Pd—0.9Ag(as $Ag_2O$)—14Cu—25.49Ni)—55.81$Fe_2O_3$—1.7ZnO | 0.203 | 0.2 | 0.05 | 0.03 |
| 52 | 1.86Ag(as $Ag_2O$)—14.02Cu—27.21Ni)—55.23$Fe_2O_3$—1.68ZnO | 0.279 | 0.27 | 0.06 | 0.36 |
| 53 | 0.1Pd—0.9Ag(as $Ag_2O$)—14Cu—25.49Ni)—55.81$Fe_2O_3$—1.7ZnO | 0.179 | 0.07 | 0.023 | 0.02 |
| 54 | 1.86Ag(as $Ag_2O$)—14.02Cu—27.21Ni)—55.23$Fe_2O_3$—1.68ZnO | 0.321 | 0.15 | 0.05 | 0.028 |
| 55 | 1.86Ag(as $Ag_2O$)—14.02Cu—27.21Ni)—55.23$Fe_2O_3$—1.63ZnO | 0.212 | 0.19 | 0.02 | 0.075 |
| 56 | 1.86Ag(as $Ag_2O$)—14.02Cu—27.21Ni)—55.23$Fe_2O_3$—1.68ZnO | 0.194 | 0.13 | 0.01 | 0.02 |
| 57 | 1.0Ag(as $Ag_2O$)—14Cu(as CuO)—27.5Ni)—55.8$Fe_2O_3$—1.7ZnO | 0.202 | 0.12 | 0.023 | 0.03 |
| 58 | 1.86Ag(as $Ag_2O$)—14.02Cu—27.21Ni)—55.23$Fe_2O_3$—1.68ZnO | 0.241 | 0.10 | 0.01 | 0.02 |

The results in Table 3 show low levels of aluminum contamination by the inert anodes. In addition, the inert anode wear rate was extremely low in each sample tested. Optimization of processing parameters and cell operation may further improve the purity of aluminum produced in accordance with the invention.

Inert anodes are particularly useful in electrolytic cells for aluminum production operated at temperatures in the range of about 800–1,000° C. A particularly preferred cell operates at a temperature of about 900–980° C., preferably about 930–970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

While the invention has been described in terms of preferred embodiments, various changes, additions and modifications may be made without departing from the scope of the invention as set forth in the following claims.

What is claimed is:

1. A method of producing commercial purity aluminum comprising:

passing current between a cermet inert anode and a cathode through a bath comprising an electrolyte and aluminum oxide; and recovering aluminum comprising less than 0.18 weight percent Fe, a maximum of 0.1 weight percent Cu, and a maximum of 0.034 weight percent Ni.

2. The method of claim 1, wherein the inert anode comprises an oxide containing Fe.

3. The method of claim 1, wherein the inert anode comprises Cu.

4. The method of claim 1, wherein the inert anode comprises an oxide containing Ni.

5. The method of claim 1, wherein the inert anode comprises Cu and an oxide containing Fe and Ni.

6.The method of claim 1, wherein the inert anode is made from $Fe_2O_3$, NiO and ZnO.

7. The method of claim 6, wherein the inert anode further comprises at least one metal selected from Cu, Ag, Pd, Pt, Au, Rh, Ru, Ir and Os.

8. The method of claim 7, wherein the at least one metal is selected from Cu, Ag, Pd and Pt.

9. The method of claim 7, wherein the at least one metal comprises Cu and at least one of Ag and Pd.

10. The method of claim 7, wherein the at least one metal comprises Ag.

11. The method of claim 10, wherein the Ag is provided from $Ag_2O$.

12. The method of claim 1, wherein the inert anode comprises at least one ceramic phase of the formula $Ni_{1-x-y}Fe_{2-x}M_yO_4$, where M is Zn and/or Co, x is from 0 to 0.5 and y is from 0 to 0.6.

13. The method of claim 12, wherein M is Zn.

14. The method of claim 13, wherein x is from 0.05 to 0.2 and y is from 0.01 to 0.5.

15. The method of claim 12, wherein M is Co.

16. The method of claim 15, wherein x is from 0.05 to 0.2 and y is from 0.01 to 0.5.

17. The method of claim 1, wherein the inert anode is made from a composition comprising about 40.48 weight percent $Fe_2O_3$, about 43.32 weight percent NiO, about 0.2 weight percent ZnO, about 15 weight percent Cu, and about 1 weight percent Pd.

18. The method of claim 1, wherein the inert anode is made from a composition comprising about 57 weight percent $Fe_2O_3$, about 27.8 weight percent NiO, about 0.2 weight percent ZnO, about 15 weight percent Cu, and about 1 weight percent Pd.

19. The method of claim 1, wherein the inert anode is made from a composition comprising about 56.9 weight percent $Fe_2O_3$, about 27.9 weight percent NiO, about 0.2 weight percent ZnO, about 14 weight percent Cu, about 0.95 weight percent Ag, and about 0.05 weight percent Pd.

20. The method of claim 1, wherein the inert anode anode is made from a composition comprising about 55.95 weight percent $Fe_2O_3$, about 27.35 weight percent NiO, about 1.7 weight percent ZnO, about 14 weight percent Cu, about 0.9 weight percent Ag, and about 0.1 weight percent Pd.

21. The method of claim 1, wherein the inert anode is made from a composition comprising about 55.23 weight percent $Fe_2O_3$, about 27.21 weight percent NiO, about 1.68 weight percent ZnO, about 14.02 weight percent Cu, and about 1.86 weight percent $Ag_2O$.

22. The method of claim 1, wherein the recovered aluminum comprises a maximum of 0.15 weight percent Fe, 0.034 weight percent Cu, and 0.03 weight percent Ni.

23. The method of claim 1, wherein the recovered aluminum comprises a maximum of 0.13 weight percent Fe, 0.03 weight percent Cu, and 0.03 weight percent Ni.

24. The method of claim 1, wherein the recovered aluminum further comprises a maximum of 0.2 weight percent Si, 0.03 weight percent Zn, and 0.03 weight percent Co.

25. The method of claim 1, wherein the recovered aluminum comprises a maximum of 0.10 weight percent of the total of the Cu, Ni and Co.

26. A method of producing commercial purity aluminum comprising:

passing current between an inert anode and a cathode through a bath comprising an electrolyte and aluminum oxide, wherein the inert anode comprises a metal phase including Ag and at least a portion of the Ag is provided from $Ag_2O$; and recovering aluminum comprising a maximum of 0.20 weight percent Fe, 0.1 weight percent Cu, and 0.034 weight percent Ni.

27. A method of producing commercial purity aluminum comprising:

passing current between an inert anode and a cathode through a bath comprising an electrolyte and aluminum oxide wherein the inert anode comprises at least one ceramic phase of the formula $Ni_{1-x-y}Fe_{2-x}M_yO_4$, where M is Zn and/or Co, x is from 0 to 0.5 and y is from 0 to 0.6; and recovering aluminum comprising a maximum of 0.20 weight percent Fe, 0.1 weight percent Cu, and 0.034 weight percent Ni.

28. The method of claim 27, wherein M is Zn.

29. The method of claim 28, wherein x is from 0.05 to 0.2 and y is from 0.01 to 0.5.

30. The method of claim 27, wherein M is Co.

31. The method of claim 30, wherein x is from 0.05 to 0.2 and y is from 0.01 to 0.5.

* * * * *